United States Patent [19]

Sujansky

[11] 4,055,450

[45] Oct. 25, 1977

[54] EXPLOSIVE COMPOSITION CONTAINING AMINE SOLVATING AGENT

[75] Inventor: Vladimir Sujansky, Burwood, Australia

[73] Assignee: ICI Australia Limited, Australia

[21] Appl. No.: 724,214

[22] Filed: Sept. 17, 1976

[30] Foreign Application Priority Data

Oct. 10, 1975 Australia ..... 3535/69

[51] Int. Cl.[2] ..... C06B 31/30

[52] U.S. Cl. ..... 149/60; 149/44; 149/61; 149/76; 149/83; 149/94

[58] Field of Search ..... 149/44, 60, 61, 94, 149/76, 83

[56] References Cited

U.S. PATENT DOCUMENTS

| | | | |
|---|---|---|---|
| 3,294,601 | 12/1966 | Gordon | 149/60 |
| 3,496,040 | 2/1970 | Partridge | 149/60 X |
| 3,524,777 | 8/1970 | Wakazono et al. | 149/60 X |
| 3,619,308 | 11/1971 | Caldwell et al. | 149/60 |
| 3,676,236 | 7/1972 | Klima | 149/60 X |
| 3,695,947 | 10/1972 | Edwards | 149/60 X |

*Primary Examiner*—Stephen J. Lechert, Jr.
*Attorney, Agent, or Firm*—Cushman, Darby & Cushman

[57] ABSTRACT

Gelled explosive compositions of matter based on inorganic oxygen releasing salt material and comprising from 0 to 5% w/w of water, from 0.1 to 5% w/w of gum and from 1 to 30% w/w of an amine which in liquid form is capable of solvating said gum.

15 Claims, No Drawings

EXPLOSIVE COMPOSITION CONTAINING AMINE SOLVATING AGENT

This invention relates to explosive compositions, processes for their preparation, and uses to which they may be put. More particularly the invention relates to explosive compositions which are in a gelled form, for example as a gel which is amenable to extrusion.

Extrudable gelled explosive compositions have been known for a considerable period. Such prior art compositions have been based on high explosives such as nitroglycerine and contained filling materials and gelling agents which were used to obtain the desired physical characteristics. Whilst such explosive compositions were satisfactory as blasting agents, they suffered from the disadvantage that the necessity to use high explosives as components caused their preparation, transport and use to be hazardous. Because of the hazardous nature of such compositions there has been a desire to prepare explosive compositions which were less hazardous and preferably devoid of high explosive material. Such a desire has been satisfied in part by the development of free flowing compositions based on mixtures of ammonium nitrate and fuel oil and on water based explosive compositions which are in the form of pumpable slurries and are usually based on ammonium nitrate and contain from 5 to 35% w/w of water.

We have now discovered new explosive compositions which are devoid of high explosives and are in a gelled form. They are eminently suitable for packaging into cartridge cases and provide safe alternatives for use in applications for which gelled high explosive compositions hitherto have been used. Our discovery is derived from the surprising observation that in the absence of added water certain organic compounds, typically polar compounds for example amines such as alkylene diamines, alkanolamines or alkyl amines, were capable of solvating gums which hitherto had been conventionally solvated by media which were essentially aqueous. Typically gums which could be so solvated included those of the galactomannan type and derivatives thereof. The solvated reaction product so obtained was found to be suitable for use in the preparation of thickened or gelled explosive compositions comprising one or more inorganic oxygen releasing salts, more particularly in the preparation of such compositions containing no added water or only a small proportion of added water.

Accordingly we provide an explosive composition of matter comprising firstly at least one inorganic oxygen releasing salt; secondly from 0 to 5% w/w of water; thirdly from 0.1 to 5% w/w, preferably from 0.3 to 3% w/w, of gum selected from the group consisting of galactomannan gums and derivatives thereof and fourthly from 1 to 30% w/w, preferably from 5 to 15% w/w, of an amine, which in liquid form is capable of solvating said gum. The ratio of the solvating material to gum will depend to some extent on the physical characteristics required in the composition and the nature of these components. On a weight basis an excess of solvating material is desirable, for example such a ratio may suitably lie in the range from 2:1 to 50:1.

The amine referred to above may be chosen from a variety of chemicals provided that under the conditions of use it is capable of reacting with or solvating the gum material referred to above. Very suitably the amine may be a liquid material. However amines which are solids or semisolids at ambient temperatures and which may be liquified during the processes used in making our compositions are also useful. Preferably the amine should be capable of reacting with the gum material in the substantial absence of added water.

As typical examples of suitable amines there may be mentioned primary, secondary and tertiary amines of the aliphatic type and containing up to 16 carbon atoms. Such amines include normal primary aliphatic amines ranging from $C_3H_7NH_2$ to $C_9H_{19}NH_2$ which are liquids at ambient temperatures, and those from $C_{10}H_{21}NH_2$ to $C_{13}H_{27}NH_2$ which have melting points from about 17° to 27° C. Other suitable materials include butyldimethylamine, butylethylamine, sec-butylethylamine, dibutylamine, di-sec-butylamine, diisoamylamine, diethylamine, triethylamine, diethylmethylamine diethyl N-nitroamine, diheptylamine, dihexylamine, diisobutylamine, diisopropylamine, dimethylisobutylamine, dimethylpentylamine, di-2-octylamine, dipentylamine, ethylmethylamine, triisoamylamine, triisobutylamine, tripentylamine, tripropylamine, 1,2-diaminoethane, 1,2-diaminopropane, 1,3-diaminopropane, 2,2'-diaminodiethylamine, allylmethylamine, allylamine, 2-aminobutane, 1-amino-3-methylbutane, 2-amino-2-2-methylbutane, 2-amino-3-methylbutane, 3-amino-2,2-dimethylbutane, 5-amino-4-methylhexene, dicyclohexylamine, ethanolamine, diethanolamine, triethanolamine, aminoethylethanolamine, 2-amino-2'hydroxy diethylamine, 2,2'-dihydroxydiethylmethylamine, methoxydiethylmethylamine, perfluorotripropylamine, and diphenylethylamine. One or more of such compounds may be present in our compositions.

The inorgranic oxygen releasing salts used in our compositions may be, for example, inorganic nitrates, chlorates and perchlorates and mixtures thereof. We prefer that the oxygen releasing salt material be chosen from the nitrates of the alkali and alkaline earth metals or ammonium and of these we prefer sodium nitrate, calcium nitrate and ammonium nitrate. The amount of oxygen releasing salt in our explosive compositions is not narrowly critical; we have found that compositions containing amounts of oxygen releasing salt from 50% w/w to 90% w/w of the total composition are satisfactory and amounts from 65% w/w to 85% w/w are preferred. The particle size and shape of the oxygen releasing salt is not narrowly critical and is well known from the art of ammonium nitrate manufacture. Powdered particles are especially satisfactory and prilled particles may also be used.

The proportion of water in our compositions should be comparatively small. The presence of added water is not essential to the utility of our compositions although the presence of small amounts of water in the compositions does not appear to be deleterious to their efficacy as explosive materials. Thus up to about 5% w/w, preferably up to about 3% w/w, of added water together with such water as is present in the components can be tolerated in the compositions.

Gums which are suitable for use in our compositions include those of the galactomannan type. Galactomannan type gums are well known and include for example guar gum and derivatives thereof. Certain of these derivatives are particularly useful in the preparation of our compositions and from amongst such derivatives of these natural gums a typical example is a gum wherein the basic polysaccharide molecule has been modified to provide a hydroxypropyl guar gum. A typical derivative of this type is available commerically under the trade name of "Gendriv" 492. ("Gendriv" is a registered trade mark). The desired degree of gelation may be achieved by suitable choice of the proportions in the compositions of the gum material and the amine. If desired however the degree of gelation can be controlled further by the incorporation into our compositions of, for example, materials known to crosslink such gums such as chromates like zinc chromate or suitable redox systems. Such crosslinking agents may be incorporated conveniently as solids or as aqueous or non aqueous solutions or suspensions.

Optionally, materials conventionally used as fillers, fuel materials or modifiers in extrudable gelled explosives of the prior art may also be incorporated in our compositions. Such materials include for example nitrocellulose, china clay, cellulosic materials such as woodmeal or sawdust, cereal products such as flours, dextrins or starches, or surfactants such as those of the non-ionic type. Yet again it may also be desirable under certain circumstances to incorporate into our compositions metals in divided form. Typically such metals include magnesium, silicon or aluminium, alloys thereof, or modifications thereof such as the reaction product of aluminium with resin acids, rosin or salts thereof.

Our compositions may be prepared by simple mixing methods. Thus it is convenient to mix the said inorganic oxygen releasing salt material and the said amine and to this mixture to admix the desired amount of gum and any other optional components. When it is desirable to crosslink the gel so formed, it is desirable to add a crosslinking agent as the last component of the composition.

The compositions of our invention are sensitive to detonation and are suitable for use as blasting agents especially in the form of explosive cartridges. Thus they may be packaged in cartridge cases fabricated from plastic materials such as polyethylene or polyethylene terephthalate, or made from metal foil for example aluminium foil. They may also be packaged in cartridge cases conventionally used to package gelled nitroglycerine explosives such as coated paper or cardboard which has been waxed or lacquered or to which has been applied a coating of a plastic material such as polyvinylidene chloride. When paper based materials are used to fabricate the cartridge cases such materials may be in the form of single sheets or laminates such as a plied paper or a paper laminate comprising a metal foil as one component.

Our invention is now illustrated by, but in no way limited to, the following examples in which all parts and percentages are on a weight basis unless otherwise stated.

EXAMPLE 1

To a stirred blend of 719 parts of ammonium nitrate and 272 parts of ethylenediamine there was added 8 parts of "Gendriv" 492. The resultant mixture was stirred until a gel was formed whereupon 1 part of zinc chromate was incorporated into the gel. The resultant product was stored at room temperature for 16 hours and then placed in plastic cylindrical containers 9.5 cm long and of diameter 4.5 cm. The explosive cartridges so formed were detonated at 18° C by means of a No 6 copper detonator.

EXAMPLE 2

To a stirred mixture of 689 parts of ammonium nitrate, 166 parts of sodium nitrate and 113 parts of ethanolamine there was added 8 parts of "Gendriv" 492. After the mixture was converted to a gel form a mixture of 2 parts of zinc chromate and 22 parts of water was incorporated into the gel and the resultant product was stored at room temperature for 16 hours. Cartridges of the composition so obtained were prepared as described in Example 1 and were detonated at 18° C by means of two No 8 aluminium detonators.

EXAMPLES 3 TO 6 INCLUSIVE

In these examples a gelled explosive composition was prepared from the components set out in Table I by the following general procedure. Powdered ammonium nitrate and powdered sodium nitrate were added to the ethanolamine and the mixture was heated with stirring to 80° C. The surfactant, which was condensate of stearic acid with ethylene oxide and contained 9 moles of ethylene oxide per 1 mole of stearic acid, and the "Gendriv" 492 were then added. The mixture was stirred until a gel was formed, whereupon the stirred mixture was cooled, the nitrocellulose was incorporated into the mixture and finally zinc chromate, either in the form of a solid or as an aqueous suspension, was admixed into the composition. The composition was stored for 4 hours and extruded into cartridge cases fabricated from waxed paper and being 20 centimeters long and having a diameter of 3.8 centimeters. The cartridges so formed were detonated at 10° C by means of the number of No 8 aluminium detonators set out in Table I wherein the velocity of detonation is also set out.

| Component | Example 3 | Example 4 | Example 5 | Example 6 |
|---|---|---|---|---|
| Ammonium nitrate | 621 parts | 670 parts | 648 parts | 646 parts |
| Sodium nitrate | 200 parts | 161 parts | 161 parts | 200 parts |
| Ethanolamine | 150 parts | 113 parts | 113 parts | 125 parts |
| Water | — | 22 parts | 44 parts | — |
| Nitrocellulose | 19.5 parts | 19.5 parts | 19.5 parts | 19.5 parts |
| Surfactant | 5 parts | 5 parts | 5 parts | 5 parts |
| "Gendriv" 492 | 8 parts | 8 parts | 8 parts | 8 parts |
| Zinc chromate | 1.5 parts | 1.5 parts | 1.5 parts | 1.5 parts |
| Detonators used | 2 | 1 | 1 | 1 |
| Velocity of detonation (kilometers per second) | 2.9 | 2.9 | 2.0 | 2.7 |

EXAMPLE 7

An explosive composition was prepared by dispersing 25 parts of hydroxypropyl guar gum and 125 parts of ammonium nitrate in 500 parts of n-butylamine by agitating the mixture at a temperature of 50° C in a container fitted with a water cooled condenser for four hours during which time a gel was formed. There was then admixed with the gel 550 parts of n-butylamine, 8375 parts of ammonium nitrate, 420 parts of calcium nitrate and 5 parts of zinc chromate.

EXAMPLE 8

An explosive composition was prepared by dispersing 34 parts of hydroxypropyl guar gum and 200 parts of ammonium nitrate in 280 parts of diethylamine, agitating the mixture at a temperature of 40° C in a container fitted with a water cooled condenser for 3 hours so as to form a gel and then adding to and mixing with the gel 20 parts of woodmeal, 20 parts of water wet nitrocellulose containing 30% water and 446 parts of ammonium nitrate.

EXAMPLE 9

An explosive composition was prepared by dispersing 250 parts of guar gum and 1250 parts of ammonium nitrate in 1250 parts of diethylamine, agitating the mixture so as to form a gel and then adding to and mixing with the gel 205 parts of water wet nitrocellulose containing 30% water, 2000 parts of sodium nitrate, 5000 parts of ammonium nitrate and 45 parts of zinc chromate.

EXAMPLE 10

An explosive composition was prepared by the general procedure of Example 9 except that the guar gum of that example was replaced by 250 parts of locust bean gum.

EXAMPLE 11

A mixture of 650 parts of ammonium nitrate, 180 parts of sodium nitrate, 150 parts of an aqueous 70% solution of ethylamine, 7 parts of guar gum, 10 parts of pregelled starch and 3 parts of the surfactant used in Example 3 was stirred for 30 minutes at a temperature of 80° C in a reaction vessel fitted with a condenser through which cold water was circulated. During this period some ammonia was evolved from the mixture and thereafter the gelled mixture was extruded into cylindrical plastic containers 76 millimeters long and having a diameter of 38 millimeters. The contents of the containers were cooled to a temperature of 18° C and each of the cartridges so formed was detonated by means of a No 6 aluminium detonator.

EXAMPLE 12

470 parts of ethanolamine, 100 parts of urea, 200 parts of ammonium nitrate, 200 parts of sodium nitrate, 10 parts of guar gum and 20 parts of pregelled starch were mixed, heated to a temperature of 80° C and maintained at that temperature for 30 minutes, after which time the gel which had formed was cooled to ambient temperature. 2214 parts of ammonium nitrate and 357 parts of atomised aluminium powder were then added to the gel with stirring and the explosive mixture so obtained was placed in cylindrical plastic containers which were 88 millimeters long and has a diameter of 45 millimeters. The cartridges so formed were detonated by means of three No 8 aluminium detonators.

EXAMPLE 13

500 parts of ethanolamine, 425 parts of an aqueous 70% solution of ethylamine, 500 parts of ammonium nitrate and 500 parts of sodium nitrate were mixed, heated to a temperature of 80° C, maintained at that temperature for 30 minutes and then cooled to a temperature of 20° C with stirring. 25 parts of guar gum and 50 parts of pregelled starch were then added and the mixture was stirred for 30 minutes during which time a gel was formed. 700 parts of atomised aluminium powder, 300 parts of pregelled starch and 7000 parts of ammonium nitrate were incorporated into the gel by mixing and kneading the components for five minutes. The explosive composition was fed into cylindrical plastic containers 88 millimeters long and having a diameter of 45 millimeters to form cartridges which were detonated by means of three No 8 aluminium detonators.

I claim:

1. A gelled explosive composition which is essentially non-aqueous comprising firstly from 50 to 90% w/w of inorganic oxygen releasing salt material selected from the group consisting of the nitrate, chlorate and perchlorate of the group consisting of the alkali metals, the alkaline earth metals and ammonium; secondly from 0 to 5% w/w of water; thirdly from 0.1 to 5% w/w of gum selected from the group consisting of galactomannan gums and derivatives thereof; and fourthly as a solvating agent for said gum from 1 to 30% w/w of an amine in liquid from.

2. A composition according to claim 1 wherein the said oxygen releasing salt material is selected from the group consisting of sodium nitrate, calcium nitrate and ammonium nitrate and constitutes from 65 to 85% w/w of the said composition.

3. A composition according to claim 1 wherein said gum constitutes from 0.3 to 3% w/w of said composition.

4. A composition according to claim 1 wherein said gum is guar gum.

5. A composition according to claim 1 wherein said gum is locust bean gum.

6. A composition according to claim 1 wherein said gum is hydroxypropyl guar gum.

7. A composition according to claim 1 wherein said amine constitutes from 5 to 15% w/w of said composition.

8. A composition according to claim 1 wherein said amine is selected from the group consisting of alkylene diamines, alkanolamines and alkylamines.

9. A composition according to claim 8 wherein said alkylamine contains from 2 to 16 carbon atoms.

10. A composition according to claim 8 wherein said amine is ethylene diamine.

11. A composition according to claim 8 wherein said amine is ethanolamine.

12. A composition according to claim 8 wherein said amine is n-butylamine.

13. A composition according to claim 8 wherein said amine is diethylamine.

14. A composition according to claim 8 wherein said amine is ethylamine.

15. A process for manufacturing a gelled explosive composition which process comprises reacting from 0.1 to 5 parts by weight of gum selected from the group consisting of galactomannan gums and derivatives thereof with from 1 to 30 parts by weight of a solvating amine in liquid form in admixture with from 50 to 90 parts by weight of at least one inorganic oxygen releasing salt material selected from the group consisting of the nitrate, chlorate, and perchlorate of the group consisting of the alkali metals, the alkaline earth metals and ammonium.

* * * * *